United States Patent [19]

Usui et al.

[11] Patent Number: 4,753,685

[45] Date of Patent: Jun. 28, 1988

[54] ALUMINUM ALLOY SHEET WITH GOOD FORMING WORKABILITY AND METHOD FOR MANUFACTURING SAME

[75] Inventors: Eiki Usui, Tichigi; Takashi Inaba, Tochigi, both of Japan

[73] Assignee: Kabushiki Kaisha Kobe Seiko Sho, Kobe, Japan

[21] Appl. No.: 582,706

[22] Filed: Feb. 23, 1984

[30] Foreign Application Priority Data

Feb. 25, 1983 [JP] Japan ..... 58-30563
Feb. 25, 1983 [JP] Japan ..... 58-30565

[51] Int. Cl.[4] ..... C22F 1/04

[52] U.S. Cl. ..... 148/2; 148/11.5 A; 148/12.7 A; 148/417; 148/439

[58] Field of Search ..... 148/11.5 A, 2, 439, 148/417, 12.7 A

[56] References Cited

U.S. PATENT DOCUMENTS 4,282,044 8/1981 Robertson et al. ..... 148/11.5 A
4,431,461 2/1984 Hoshino et al. ..... 148/11.5 A

FOREIGN PATENT DOCUMENTS 52-105509 9/1977 Japan .

*Primary Examiner*—R. Dean
*Attorney, Agent, or Firm*—Oblon, Fisher, Spivak, McClelland & Maier

[57] ABSTRACT

Disclosed herein are: (1) a formable bake-hardening type aluminum alloy sheet, containing 0.2–0.7 wt % of Fe, 0.05–0.5 wt % of Cu, 0.5–2.5 wt % of Mg, 0.5–2.0 wt % of Mn and optionally 0.05–1 wt % of Zn under the condition of Fe wt % +(Mn wt %×1.07)+(Mg wt %×0.27)≦3.0, and intermetallic compounds of less than 45 microns in size and an areal rate of 0.5–5% as observed from the surface of a rolled sheet and an average crystal grain width smaller than 25 microns; and (2) a method for producing such bake-hardening type aluminum alloy sheets.

8 Claims, 4 Drawing Sheets

ALUMINUM ALLOY SHEET WITH GOOD FORMING WORKABILITY AND METHOD FOR MANUFACTURING SAME

BACKGROUND OF THE INVENTION

1. Field of the Invention

This invention relates to an aluminum alloy sheet with improved forming workability and a method for manufacturing same. More particularly, the present invention concerns a bakehardening type aluminum sheet suitable for use in canning, which is improved especially in forming workability, and a method for manufacturing same.

2. Description of the Prior Art

Generally, aluminum alloy materials are used in canning as can bodies, can ends and can tabs, of which the material for can bodies is required to have satisfactory properties in: (1) drawability and redrawability; (2) ironing workability; (3) resistance to scoring; (4) doming formability; (5) appearance; (6) necking formability; (7) flangeability; (8) deep drawability; (9) resistance to pressure; (10) column strength; and (11) resistance to corrosion.

In order to realize a weight reduction of a can by a reduction in thickness of aluminum sheet material, it is necessary to reduce a can wall thickness within a range which is free of problems concerning can strength including column strength and so forth. For this purpose, it is a paramount requisite to attain improvements: (1) in ironing workability; (2) in flangeability since a reduction in wall thickness will lower flangeability; (3) in rivet formability for enhancing the effect of a reduction in wall thickness as a can end material; and (4) in bending workability for increasing an effect as a tab material in the same way as the can end material.

Of the above-mentioned properties, improvements are necessary especially in flangeability and rivete formability which are essential properties in a forming operation involving local elongation in particular.

SUMMARY OF THE INVENTION

In consideration of the foregoing aspects, the present inventor has conducted a research on canning aluminum alloys, and found that, in order to prevent concentration of stress in aluminum alloy sheet, it is necessary to limit intermetallic compounds which are normally contained in a can material. Nevertheless, it has also been found that intermetallic compounds in a can material have an excellent effect of preventing build-up of an aluminum alloy on a die surface in a can body ironing stage, and that intermetallic compounds of an appropriate size serve as nucleus at the time of recrystallization so that it is desirable for a certain amount of intermetallic compounds to be distributed uniformly from the standpoint of producing average crystal grains smaller than 25 microns.

The present invention is based on the above-mentioned excellent properties of an aluminum alloy and various findings made by the inventor, and has as its object the provision of a bake-hardening type aluminum alloy sheet which is improved in ironing workability, flangeability and rivet formability and which can serve not only as a can body material but also as a can tab or end material to permit reductions in can weight, and a method for producing such a bake-hardening type aluminum alloy sheet.

According to one aspect of the present invention, there is provided a formable bake-hardening type alluminum alloy sheet containing 0.2–0.7 wt% of Fe, 0.05–0.5 wt% of Cu, 0.5–2.5 wt% of Mg and 0.5–2.0 wt% of Mn in a range of Fe wt% (Mn wt%$\times$1.07)+(Mg wt%$\times$0.27)$\leqq$3.0, and intermetallic compounds of less than 45 microns in size at an areal rate of 0.5–5% as observed form the surface of a rolled sheet, having an average width of crystal grains smaller than 25 microns as observed from the rolled sheet surface.

According to another aspect of the present invention, there is provided a method for producing a formable bake-hardening type alluminum alloy strip, comprising: smelting an aluminum alloy containing 0.2–0.7 wt% of Fe, 0.05–0.5% of Cu, 0.5–2.5 wt% of Mg and 0.5–2.0 wt% of Mn in a range of Fe wt%+(Mn wt%$\times$1.07)+(Mg wt%$\times$0.27)$\leqq$3.0; casting the aluminum alloy in a thickness greater than 100 mm; soaking the resulting ingot at a temperature higher than 530° C.; hot rolling the soaked ingot optionally followed by cold rolling; heating the rolled work to a temperature of 400°–600° C. at a heating speed higher than 100° C./min; immediately thereafter or after retaining for a time period shorter than 10 minutes, cooling the work to a temperature below 150° C. at a cooling speed higher than 100° C./hour thereby producing average crystal grains smaller than 25 microns while holding in solid solution the components contributive to bake hardening; and cold rolling the work at a reduction rate greater than 10% with a total rolling rate of hot and cold rolling greater than 99%.

According to a further aspect of the present invention, there is provided a method for producing a formable bake-hardening type alluminum alloy strip, comprising: smelting an aluminum alloy containing 0.2–0.7 wt% of Fe, 0.05–0.5% of Cu, 0.5–2.5 wt% of Mg and 0.5–2.0 wt% of Mn in a range of Fe wt%+(Mn wt%$\times$1.07)+(Mg wt%$\times$0.27)=2.0–3.0; casting the alloy in a thickness smaller than 50 mm by quenching continuous casting optionally followed by hot rolling; optionally cold rolling the resulting work after or without a heat treatment at a temperature higher than 300° C.; heating the work to a temperature of 400°–600° C. at a heating speed higher than 100° C./min; immediately thereafter or after retaining for a time period shorter than 10 minutes, cooling the work to a temperature below 150° C. at a cooling speed higher than 100° C./hour to make the average crystal grains smaller than 25 microns and holding in solid solution the components contributive to bake hardening; and cold rolling the work at a reduction rate greater than 10% with a total rate of hot and cold rolling greater than 90%.

In one preferred form of the present invention, the alluminum alloy may further contain 0.05–1 wt% of Zn to add further improvements in formability as will be described hereinlater.

The above and other objects, features and advantages of the present invention will become apparent from the following description and appended claims, taken in conjunction with the accompanying drawings.

DESCRIPTION OF PREFERRED EMBODIMENTS

Figure 1:
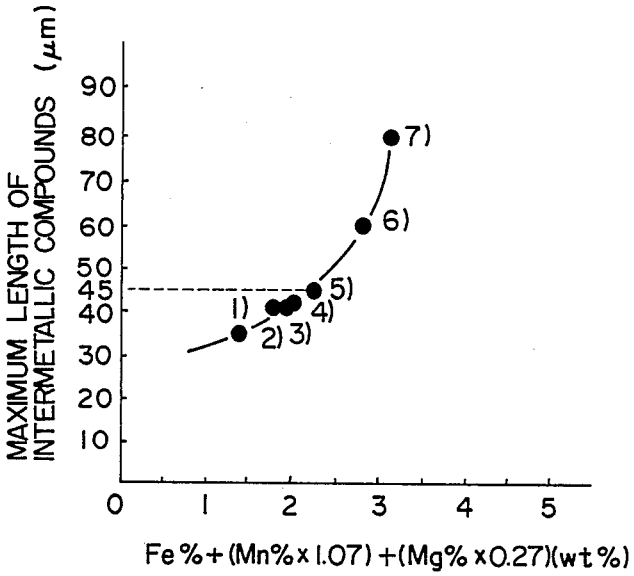
FIG. 1 is a graphic representation of the relationship between the maximum length of intermetallic compounds and the amount of Fe wt%+(Mn wt%$\times$1.07)+(Mg wt%$\times$0.27)

Now, the formable bake-hardening type aluminum alloy sheet according to the present invention and its manufacturing method are described more particularly, and firstly the description is directed to the respective components or elements and their proportions in the aluminum alloy sheet of the invention.

The component Fe which forms an intermetallic compound of $(Fe.Mn)Al_6$ together with Mn is necessary for preventing build-up of aluminum alloy on a die in an ironing stage. This effect is produced in an insufficient degree if Fe content is less than 0.2 wt% but an Fe content in excess of 0.7 wt% will lead to formation of primary structures. Therefore, Fe content should be in the range of 0.2–0.7 wt%.

The component Cu should be contained along with Mg since it dissolves in solid solution together with Mg to cause hardening in a baking stage by producing fine Al-Cu-Mg base precipitates contributing to enhancement of strength. If Cu content is less than 0.05 wt%, the just-mentioned effect is produced in an insufficient degree. On the other hand, a Cu content in excess of 0.5 wt% is sufficient for that effect but invites a considerable deterioration in corrosion resistance as a can body material. Consequently, Cu content should be in the range of 0.05–0.5 wt%.

The component Mg should be contained together with Cu for it dissolves in solid solution along with Cu, causing precipitation hardening in a subsequent stage for imparting necessary strength as a can body material. Mg which causes deterioration in corrosion resistance in a less degree as compared with Cu can be contained in a larger amount, and its content should be greater than 0.5 wt% in order to secure the above-mentioned effects. A Mg content in excess of 0.5 wt% is also required to enhance the strength which is necessary for lightening cans by a reduction in wall thickness. Although an increase in Mg content is reflected by a higher strength, it will lower formability, particularly ironing workability, flangeability and the like, increasing the possibilities of scoring. However, owing to the effect of improving scoring resistance of precipitates by an Mn content which will be described hereinlater, it is possible to obtain satisfactory properties as a can body material even if the Mg content is increased. Nevertheless, a Mg content in excess of 2.5 wt% will invite deteriorations in formability such as ironing workability and flangeability, increasing possibilities of scoring. Thus, the Mg content should be in the range of 0.5–2.5 wt%.

Different from Cu and Mg, the component Mn does not contribute to precipitation hardening, but it is as important element as Mg for imparting strength. Further, along with Al, Mn crystallizes in the form of $MnAl_6$ which serves to prevent scoring, and, under coexistence with Mg, it stabilizes the texture in the stage of recrystallization subsequent to a heat treatment, and stabilizes earing in deep drawing. These effects cannot be expected with an Mn content less than 0.5 wt%, but the amount and size of intermetallic compounds are increased with a large Mn content. If its content exceeds 2.0 wt%, primary structures are likely to crystallize, riving rise to pinholes or tear off in the ironing stage. Therefore, the Mn content should be in the range of 0.5–2.0 wt%.

The component Zn has effects of enhancing flangeability and doming formability for a can body as well as rivet formability for a can end, reducing the size of crystalline intermetallic compound of $(MnFe)Al_6$ as observed from the surface of a rolled alloy sheet, and improving dislocation transformation after plastic working such as drawing, flanging and ironing, thereby further ameliorating the properties in flangeability and rivet formability. These effects are absent if Zn content is less than 0.05 wt%. However, in spite of improvements in formability, a Zn content in excess of 1 wt% will cause a large degradation in corrosion resistance. Actually, corrosion resistance can be secured by coating after forming as in the case of can bodies which are usually coated subsequent to forming operations. Nevertheless, it is desirable to guarantee a high corrosion resistance in consideration of can ends which are normally formed after coating. Thus, the Zn content should be in the range of 0.05–1 wt%.

According to the present invention, the aluminum alloy may further contain as impurities one or more than one kind of the following elements: less than 0.5% of Si; less than 0.10% of Ti; less than 0.05% of B; and less than 0.05% of Cr.

The restriction of the amount of Fe wt%+(Mn wt%×1.07)+(Mg wt%×0.27) to a range ≦3.0 is based on the following reasons. The intermetallic compounds are largely classified into crystallized products and precipitates. Crystallization of intermetallic compounds occurs at the time of solidification in casting stage while precipitation occurs in a stage subsequent to a heat treatment to the elements which are in supersaturated state in casting stage. The precipitates are normally smaller than 1 micron in size so that they are almost negligible as a source of stress concentration. On the other hand, the crystallized products can be further classified into primary crystallization compounds produced in liquid immediately before solidification and eutectic compounds produced at the time of solidification, of which the primary crystallization compounds are apt to grow into primary structures. The growth of primary structures is largely influenced by the time duration of passing their production temperature in an actual industrial casting process which involves stagnation of molten metal, but it is possible to prevent production of primary structures and to improve formability by satisfying the above-defined range.

The areal rate of intermetallic compounds as measured from the surface of a rolled sheet is limited to 0.5-5% since there will occur the problem of metal build-up on a die in ironing stage if the areal rate is smaller than 0.5% while formability such as flangeability and rivet formability will be extremely lowered with an areal rate greater than 5%, increasing the possibility of producing pinholes in ironing stage.

The size of intermetallic compounds is restricted to a range smaller than 45 microns, should the longitudinal length of intermetallic compounds exceed about 40 microns, there will occur flange cracking frequently, increasing susceptibilities to fracturing in ironing stage. However, a rolled sheet which is produced from a large ingot of an industrial scale contains numerous intermetallic compounds so that large intermetallic compounds may exist at a very small probability. Therefore, the size of intermetallic compounds is limited to a range smaller than 45 microns.

The average width of crystal grains as measured from the surface of a rolled sheet is restricted to a range smaller than 25 microns for the purpose of compensating degradations in various forming properties resulting from the reduction in thickness and deterioration in necking formability caused by impartment of high strength after baking, and promoting the precipitation hardening. Forming characteristics such as doming formability, flangeability and ironing workability are improved by minimization of crystal grains, so that there will arise no problem in reducing the can wall thickness by holding an average crystal grains smaller than 25 microns. Should the average crystal grains exceed 25 microns, the alluminum alloy would have almost no differences from ordinary can body materials, making it difficult to attain a high strength in a reduced wall thickness. Therefore, the average crystal grains should be smaller than 25 microns.

Now, the description is directed to the method for producing the formable aluminum alloy sheet of the present invention.

In the first step, an aluminum alloy which satisfies the condition of Fe wt%+(Mn wt%×1.07)+(Mg wt%×0.27)<3.0 is cast in a thickness greater than 100 mm. This is because smaller the value of the formula, the smaller become the sizes and amounts of the respective intermetallic compounds favorably to flangeability. In a water-cooled casting process which is industrially in use, the cooling speed at the time of solidification becomes too high if the thickness of a cast strip is smaller than a certain value, suppressing production of crystallized compounds and resulting in a too small areal rate of intermetallic compounds after rolling. Thus, the thickness of the ingot should be greater than 100 mm.

The above-described ingot is subjected to a soaking treatment at a temperature above 530° C. If the temperature of this soaking treatment is lower than 530° C., a large quantity of very fine $MnAl_6$ will precipitate, which tends to suppress grain boundary transformation at the time of recrystallization of a cold rolled sheet, raising the recrystallization temperature and coarsening the crystal grains. Besides, due to a change in recrystallization structure, earing occurs at the angle of 45° with a rolling direction in deep drawing, coupled with a problem of scoring in ironing stage. In order to attain further improvements especially in ironing workability and deep drawability, the soaking treatment should be carried out at a temperature higher than 530° C.

The hot rolling which follows the soaking treatment involves no control in particular with respect to the hot rolling rate or temperature and may be conducted by an ordinary industrial method. The hot rolled work is then heated (annealed) as it is or after cold rolling if necessary.

The heating is effected at a temperature in the range of 400°-600° C. to cause recrystallization by heating (annealing), reducing earing in deep drawing by formation of recrystallization texture and at the same time producing fine and uniform crystal grains by recrystallization, while dissolving Cu in solid solution in order to guarantee the bake-hardening effect by precipitation of Al—Cu—Mg. If the temperature is lower than 400° C., it becomes difficult to dissolve Cu in solid solution. Although a higher temperature is desirable in this heating stage, it is preferred to employ a temperature higher than 430° C. in consideration of the Cu content and the heat retention time. The growth of recrystallized grains is accelerated at higher temperature and this tendency becomes conspicuous at temperatures above 600° C., making it difficult to control the crystal grains in a range smaller than 25 microns. Therefore, the heating temperature should be in the range of 400°-600° C. Further, it is necessary to raise the temperature quickly to produce fine crystal grains and to suppress production of MgO on the surface of an alloy sheet by a treatment of a short time period. To this end, the heating speed should be higher than 100° C./min.

With regard to the retention time, it has to be controlled for the purpose of producing fine crystal grains. Although this purpose can be attained readily in the case of a high temperature treatment even if the retention time is zero, the temperature may be retained for a certain time period in the case of a treatment using a relatively low temperature within the above-defined range or depending upon the composition of the alloy or other conditions of the manufacturing process. Since retention of a high temperature over a long time period will encourage growth of recrystallized grains and prohibit production of fine crystal grains, the retention time should be 10 minutes or shorter.

Furthermore, it is necessary to control the cooling speed in order to obtain precipitation hardening. More particularly, if the cooling speed is too low, precipitation takes place already in the cooling stage, failing to give sufficient precipitation hardening in baking stage. Besides, fine precipitates which are produced at relatively low temperatures in a cooling stage contribute to enhancement of strength but they deteriorate formability by raising strength prior to an ironing stage. In view of these situations, the cooling speed should be high enough, i.e., should be higher than 100° C./hr in the case of a can body material. Although there may be employed a higher cooling speed, it is recommended to resort to air cooling in the case of a material in a coil form. In the cooling stage, the temperature of the alloy has to be lowered below a predetermined level, more specifically, below a temperature at which precipitation of Al—Cu—Mg takes place, for preventing premature precipitation before baking stage. Consequently, the alloy should be cooled to a temperature below 150° C.

The cold rolling subsequent to the cooling is necessary for securing required strength as a can body material, and the rate of cold rolling varies depending upon the contents of Cu, Mg and Mn but should be greater than 10% since otherwise the effect of cold rolling could not be expected.

In a case employing both hot rolling and cold rolling, the total reduction rate should be greater than 99% in consideration of intergranular aggregation of intermetallic compounds which occurs in a large quantity in casting stage and in order to control in a preferred range the areal rate of intermetallic compounds as observed on the surface of an ultimate rolled sheet.

An aluminum alloy of Fe wt%+(Mn wt%×1.07)+(Mg wt%×0.27)=2.0–3.0 is cast in a thickness smaller than 50 mm by quenching continuous casting after smelting. This is because, if the foregoing formula has a large value, the areal rate of intermetallic compounds becomes unacceptably great in a case where the casting thickness is small and/or the total rolling rate is small. Besides, in order to increase productivity by reducing the casting thickness in a coiling method, it is necessary to cast the stock in a thickness smaller than 50 mm within the range defined by the above formula and to increase the cooling speed at the time of solidification. On the other hand, in a continuous casting method, the value of the above formula is required to be 2.0–3.0. In this manner, with a high cooling speed, there is a tendency of producing a larger number of crystallized compounds of small sizes in uniformly dispersed state.

Gathering from these situations, an appropriate areal rate is obtained when the total working rate by hot and cold rolling is greater than 90%.

After continuous casting, the stock is optionally hot rolled and subjected to a heat treatment at a temperature of higher than 300° C. if necessary for improving its rolling characteristics since continuously cast coils are very susceptible to ear cracking in coil end portions, or otherwise for the purpose of controlling the texture.

The above-mentioned areal rate of intermetallic compounds is a value which is obtained by observing a polished surface of a processed aluminum alloy sheet through an optical microscope at 400 magnification.

The invention is more particularly illustrated by the following examples.

[EXAMPLE 1]

Aluminum alloys of the chemical compositions shown in Table 1 were smelted and cast into large ingots of 400 mm, which were hot rolled into a thickness of 4 mm after a soaking treatment of 560° C.×6 hrs. After cold rolling and intermediate annealing, there were obtained specimens of 0.4 mm in thickness. Due to large differences in composition, the position of intermediate annealing was determined such that the respective alloys would have substantially the same strength upon reaching the thickness of 0.4 mm, effecting the intermediate annealing with a heating speed of 500° C./min, level heating of 500° C.×30 sec. and a cooling speed of 500° C./min. Also shown in Table 1 are distributions of intermetallic compounds (at the time point of 0.4 mm in thickness) which have different and varying chemical compositions. Table 2 shows the mechanical properties of the respective specimens (with finishing cold rolling at a rate of 60% in No. 4), in which the average crystal grain width are all smaller than 20 microns.

TABLE 1

| | Chemical Composition (wt %) | | | | | | Distrib'n of Intermet'c Comp. | | | |
|---|---|---|---|---|---|---|---|---|---|---|
| No. | Fe | Si | Cu | Mn | Ms | Ti | Fe wt % + (Mn wt % × 1.07) + (Mg wt % × 0.27 | Max length (μm) | Areal rate (%) | Number of grains >30 μm |
| 1 | 0.30 | 0.17 | 0.15 | 0.40 | 2.5 | 0.02 | 1.40 | 35 | 0.22 | 3 |
| 2 | 0.50 | 0.15 | 0.20 | 0.70 | 2.0 | 0.02 | 1.79 | 41 | 0.50 | 5 |
| 3 | 0.43 | 0.20 | 0.18 | 1.05 | 1.6 | 0.03 | 1.93 | 41 | 0.95 | 6 |
| 4 | 0.41 | 0.25 | 0.26 | 1.20 | 1.2 | 0.02 | 2.02 | 42 | 2.50 | 10 |
| 5 | 0.65 | 0.15 | 0.31 | 1.10 | 1.5 | 0.03 | 2.24 | 45 | 4.95 | 30 |
| 6 | 0.51 | 0.22 | 0.20 | 1.60 | 2.2 | 0.02 | 2.82 | 62 | 6.40 | 34 |
| 7 | 0.48 | 0.30 | 0.35 | 2.00 | 1.8 | 0.03 | 3.11 | 81 | 8.00 | 67 |

*Number per 300 mm$^2$.
Si, Ti: Impurities

TABLE 2

| | After Rolling | | | After Baking | |
|---|---|---|---|---|---|
| No. | T.S. (kg/mm$^2$) (1) | Y.S. (kg/mm$^2$) | El (%) | (200° C. × 20 min.) T.S. (kg/mm$^2$) (2) | Bake Hardening (2) − (1) (kg/mm$^2$) |
| 1 | 29.5 | 28.0 | 3.2 | 30.0 | +0.5 |
| 2 | 30.0 | 28.7 | 2.8 | 32.0 | +2.0 |
| 3 | 29.8 | 28.1 | 2.9 | 31.9 | +2.1 |
| 4 | 29.0 | 28.0 | 2.5 | 32.1 | +3.1 |
| 5 | 29.4 | 27.9 | 3.1 | 33.5 | +4.1 |
| 6 | 29.6 | 28.2 | 3.0 | 32.6 | +3.0 |
| 7 | 30.4 | 29.1 | 3.1 | 35.0 | +4.6 |

T.S.: Tensile strength
Y.S.: 0.2% yield strength
El: Elongation

As shown in Table 2, the strength after baking [(2)-(1)] is improved in all of the specimens Nos. 1 to 7.

Figure 2:
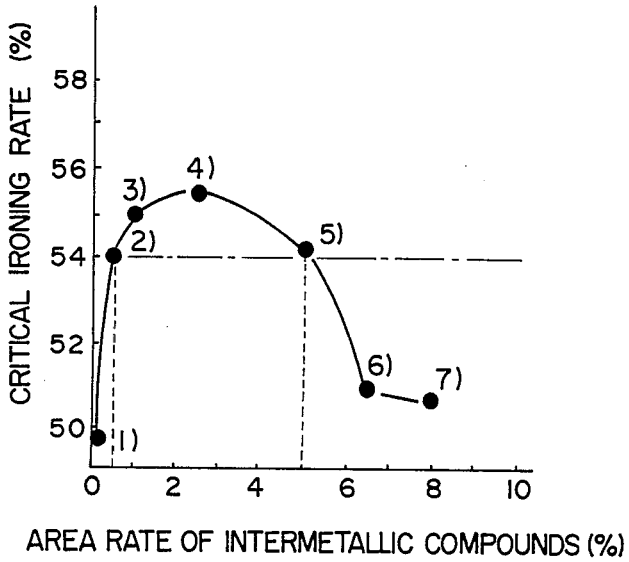
FIG. 2 is a graphic representation of the relationship between the critical ironing rate and areal rate of intermetallic compounds.
Figure 3:
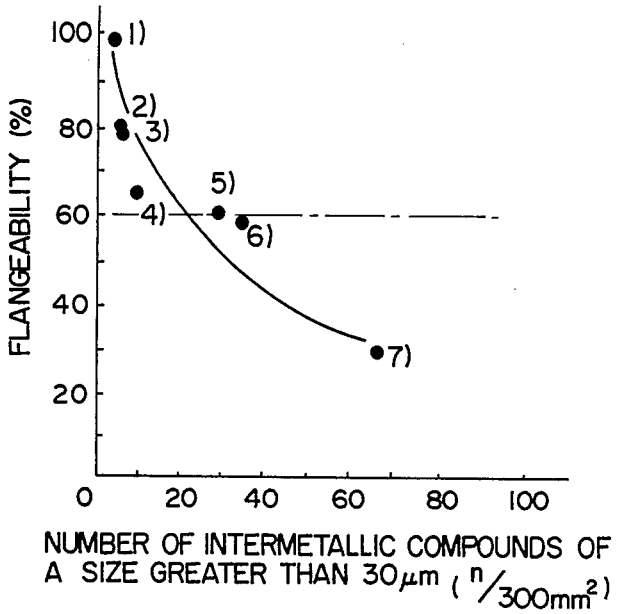
FIG. 3 is a graphic representation of the relationship between flangeability and number of intermetallic compounds of a size greater than 30 microns.

Reference is now had to FIGS. 1 to 3 which show the results of tests with regard to distributions of intermetallic compounds (crystallized products), ironing workability and flangeability of these specimens, respectively.

As seen in FIG. 1, as the value of Fe wt%+(Mn wt%×1.07)+(Mg wt%×0.27) is augmented, the size of intermetallic compounds (crystallized products) is increased, with a critical point at 45 microns beyond which the intermetallic compounds bring about detrimental deteriorations in ironing workability and flangeability. Thus, the value of Fe wt%+(Mn wt%×1.07)+(Mg wt%×0.27) should be smaller than 3.0.

Shown in FIG. 2 is the relationship between the areal rate of intermetallic compounds (crystallized products) and the ironing workability. As seen therefrom, with an areal rate smaller than 0.5% or an areal rate greater than 5%, there occurs a sharp degradation in ironing workability, failing to satisfy a required ironing workability (a critical ironing rate greater than 54%). In this instance, the areal rate was determined by observation through a optical microscope at a magnification of 400.

Referring to FIG. 3, there is shown the relationship between the number of intermetallic compounds greater than 30 μm (1/300 $mm^2$) and the flangeability (at a flange rate of 12%). As clear therefrom, the flangeability is deteriorated correspondingly to increases in the number of large intermetallic compounds.

[EXAMPLE 2]

Aluminum alloy ingots were prepared in a manner similar to and under the same conditions as in Example 1 to obtain 0.3 mm thick specimens. In order to test properties as a can end material, the specimens were subjected to finishing cold rolling at different rates so that they would have after baking a strength (Y.S.) comparable to that of a conventional material (alloy 5082). The results are shown in Table 3.

In Table 3, the rivete formability (multi-step stretching height) is required to have a height greater than a certain value for the attachment of tabs, and also influenced by distribution of intermetallic compounds, giving better results where the size and amount of intermetallic compounds are smaller.

TABLE 3

| No. | After Baking (200–250° C. × 20 min) T.S. ($kg/mm^2$) | Y.S. ($kg/mm^2$) | El (%) | *(1) mmh | *(2) | Distrib'n of Inter'c C. (μm) | (%) |
|---|---|---|---|---|---|---|---|
| 1 | 30.0 | 29.0 | 8.0 | 2.02 | | 35 | 0.22 |
| 2 | 30.5 | 29.2 | 8.2 | 2.00 | | 41 | 0.50 |
| 3 | 30.4 | 29.1 | 8.0 | 1.95 | | 41 | 0.95 |
| 4 | 30.0 | 28.8 | 7.4 | 1.90 | | 42 | 2.50 |
| 5 | 31.8 | 29.2 | 6.9 | 1.90 | Δ | 45 | 4.95 |
| 6 | 31.3 | 29. | 7.2 | 1.70 | Δ | 62 | 6.40 |
| 7 | 31.5 | 29.2 | 6.5 | 1.50 | Δ | 81 | 8.00 |
| 5082 | 36.5 | 29.0 | 8.0 | 2.00 | | 22 + | 0.19 |

*(1): Rivet formability (multi-stepped stretching height), which should satisfy a stretching height greater than 1.90 mm.
*(2): Tab property (bending property), ranked by " "(good, no cracks), " Δ " (with shrinkage) and "Δ" (no good, with fine cracks).
T.S.: Tensile strength, Y.S.: 0.2% yield strength, El: Elongation

[EXAMPLE 3]

The ingots produced in Example 1 were remelted and cast in three different thicknesses of 60 mm, 40 mm and 20 mm by the use of a small continuous casting machine under quenching condition. After heating to 400° C., the respective ingots were hot rolled into a thickness of 4 mm, followed by cold rolling and intermediate annealing to obtain specimens of 0.4 mm thick sheets. The rate of cold rolling was same as in Example 1, and the intermediate annealing was carried out with heating and cooling speeds of 500° C./min. and level heating of 550° C.×5 minutes. The mechanical properties of the specimens are shown in Table 4, in which the increases in the strength after rolling are attributable to increased amounts of solid solution in quenched ingots. Table 4 shows the values of 40 mm thick ingots since the same values were exhibited by 20 mm and 60 mm thick ingots.

Figure 4:
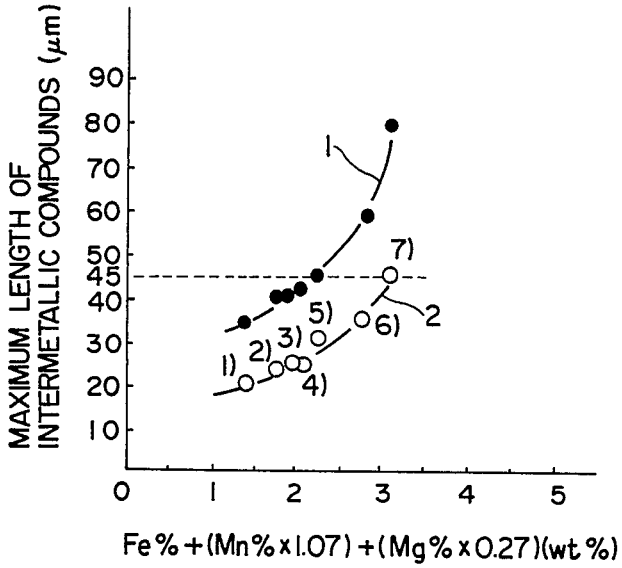
FIG. 4 is a graphic representation of the relationship between the maximum length of intermetallic compounds and the amount of Fe wt%+(Mn wt%×1.07)+(Mg wt%×0.27)
Figure 5:
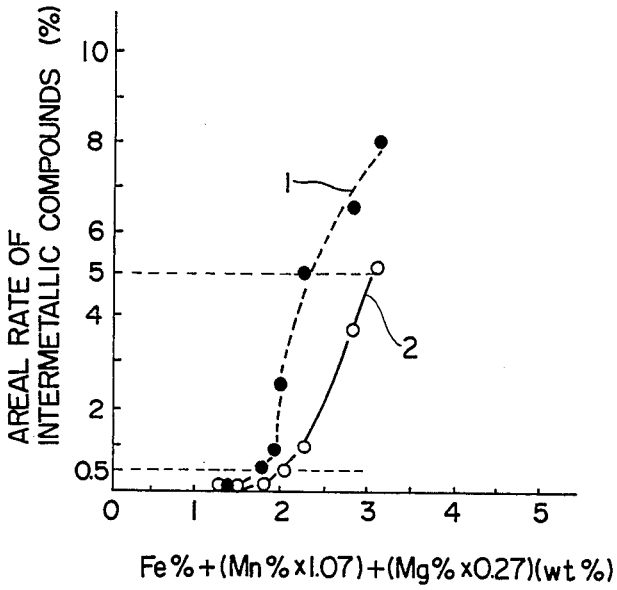
FIG. 5 is a graphic representation of the relationship between the areal rate of intermetallic compounds and the amount of Fe wt%+(Mn wt%×1.07)+(Mg wt%×0.27)
Figure 6:
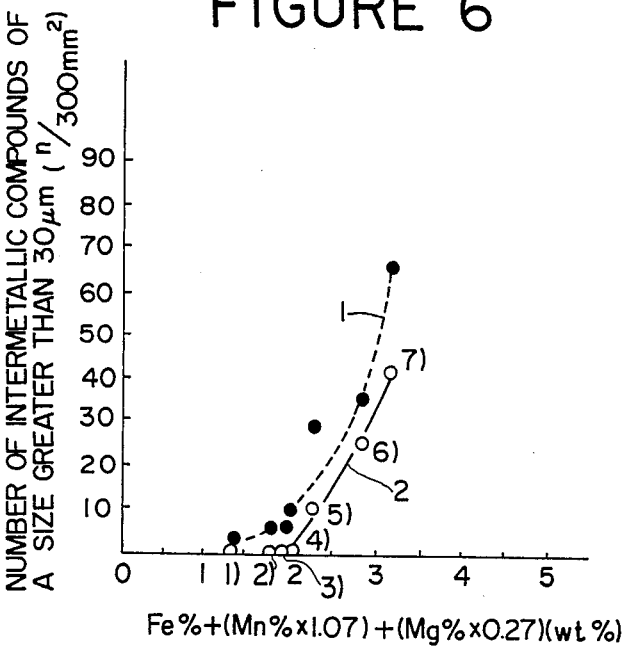
FIG. 6 is a graphic representation of the relationship between the number of intermetallic compounds greater than 30 microns and Fe wt%+(Mn wt%×1.07)+(Mg wt%×0.27)
Figure 7:
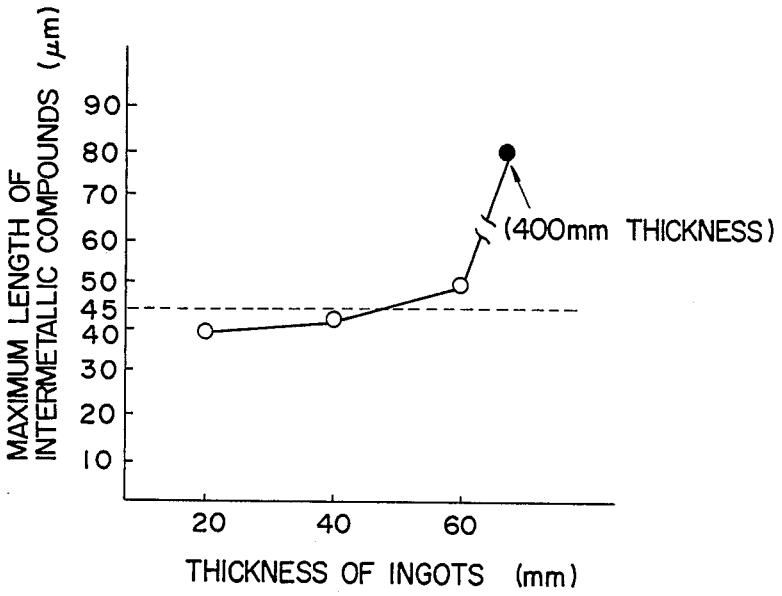
FIG. 7 is a graphic representation of the relationship between the maximum length of intermetallic compounds and thickness of ingots.

Referring to FIGS. 4 to 7, there are graphically shown distributions of intermetallic compounds in relation with the thickness of ingots (400 mm plotted by curve 1 and 40 mm plotted by curve 2). It will be seen therefrom that the length and amount of intermetallic compounds are reduced considerably in the case of 40 mm thick ingots. More specifically, FIG. 4 shows reductions in the maximum length of intermetallic compounds, and, upon comparing the values of Fe wt%+(Mn wt%×1.07)+(mg wt%×0.27) of the thick ingot (1) and thin ingot (2) on the basis of a maximum length of 45 microns, it is observed that the former exhibits an amount of 2.24 while the latter exhibits a greater amount of 3.11. On the other hand, FIG. 5 shows reductions in the areal rate of intermetallic compounds, from which it is seen that the areal rate falls in the range of 0.5–5% when Fe wt%+(Mn wt%×1.07)+(Mg wt%×0.27)=2.0–3.0. Shown in FIG. 6 are reductions in the number of intermetallic compounds greater than 30 microns. Further, as shown in FIG. 7, thin ingots contain intermetallic compounds with a maximum length greater than 45 microns upon reaching a thickness of 60 mm. With regard to the relationship between the distribution (length and amount) of intermetallic compounds and the formability, it is determined by the value of Fe wt%+(Mn wt%×1.07)+(Mg wt%×0.27), as seen from the characteristics of ironing workability of FIG. 2 and flangeability of FIG. 3.

Following are results of tests on specimens.

The 40 mm thick ingots turned out to have the following properties as can body and can end material.

The test results on properties as a can body material (0.4 mm in thickness) are shown in Tables 4 and 5. Specimens Nos. 4 to 6 satisfied the required properties in ironing workability (acceptable if higher than 54%) and flangeability (acceptable if higher than 60%), with the value of Fe wt%+(Mn wt%×1.07)+(Mg wt%×0.27) in the range of 2.0–3.0 in which intermetallic compounds has a maximum length smaller than 45 microns and an areal rate of 0.5–5% (FIG. 5). On the other hand, shown in Table 6 are the properties as can end material (0.3 mm in thickness, with a predetermined after baking strength Y.S.) in which distributions of intermetallic compounds may be considered to be same as in Table 5. Rivet formability (acceptable if greater than 1.90 mm) is remarkably improved (as compared with Table 3) and satisfactory if Fe wt%+(Mn wt%×1.07)+(Mg wt%×0.27) is smaller than 3.0. It can be gathered therefrom that, in the case of thin ingots (smaller than 50 mm in thickness), favorable results are obtained when the value of Fe wt%+(Mn wt%×1.07)+(Mg wt%×0.27) is in the range of 2 to 3. In the foregoing tests, the average crystal grain width were smaller than 25 microns.

TABLE 4

| No. | after Rolling T.S. (kg/mm²) | Y.S. (kg/mm²) | El (%) | After Baking (200° C. × 20 min) T.S. (kg/mm²) | Y.S. (kg/mm²) | El (%) |
|---|---|---|---|---|---|---|
| 1 | 30.0 | 28.3 | 3.1 | 31.0 | 26.9 | 6.8 |
| 2 | 30.4 | 29.0 | 2.9 | 33.1 | 28.4 | 7.0 |
| 3 | 30.5 | 28.4 | 2.7 | 32.8 | 28.0 | 7.2 |
| 4 | 29.5 | 28.5 | 2.7 | 33.2 | 27.9 | 6.9 |
| 5 | 29.9 | 28.9 | 3.0 | 34.4 | 28.5 | 6.8 |
| 6 | 30.2 | 28.6 | 3.1 | 33.0 | 28.2 | 7.0 |
| 7 | 31.0 | 29.7 | 3.0 | 35.8 | 29.0 | 6.5 |

T.S.: Tensile strength
Y.S.: 0.2% yield strength
El: Elongation

TABLE 5

| No. | After Rolling Stretching Formability (Er-valve) mmh | Ironing worka'ty *(3) % | After Baking Flangeability *(1) % | Fe wt % + (Mn wt % × 1.07) + (Mg wt % × 0.27) | Intermet'c Comp. distribution Max. length (μm) | Areal rate (%) | Number of grains >30 μm*(2) |
|---|---|---|---|---|---|---|---|
| 1 | 5.5 | 48.5 | 100 | 1.40 | 21 | 0.15 | 0 |
| 2 | 5.3 | 51.0 | 100 | 1.79 | 24 | 0.13 | 0 |
| 3 | 5.2 | 53.5 | 100 | 1.93 | 27 | 0.20 | 0 |
| 4 | 5.2 | 54.5 | 100 | 2.02 | 26 | 0.50 | 0 |
| 5 | 5.2 | 55.0 | 95 | 2.24 | 32 | 1.05 | 11 |
| 6 | 5.1 | 55.0 | 70 | 2.82 | 37 | 3.70 | 25 |
| 7 | 5.1 | 54.5 | 52 | 3.11 | 45 | 5.20 | 43 |

*(1): Tested at a flange rate of 12% (acceptable if greater than 60% in formable rate).
*(2): Number per 300 mm².
*(3): Critical ironing rate, acceptable if greater than 54%.

TABLE 6

| No. | After Baking (200° C. × 20 min) T.S. (kg/mm²) | Y.S. (kg/mm²) | El (%) | Rivet *(1) Formability (multi-step stretching height) | Tab Property *(2) (bending property) |
|---|---|---|---|---|---|
| 1 | 30.2 | 29.4 | 8.0 | 2.05 mmh | |
| 2 | 30.6 | 29.5 | 8.2 | 2.02 | |
| 3 | 30.5 | 29.4 | 8.0 | 2.02 | |
| 4 | 30.0 | 28.9 | 7.4 | 2.02 | |
| 5 | 31.9 | 29.3 | 6.9 | 1.95 | |
| 6 | 31.5 | 29.5 | 7.2 | 1.95 | |
| 7 | 31.7 | 29.2 | 6.5 | 1.85 | Δ |
| 5082 | 36.5 | 29.0 | 8.0 | 2.00 | |

*(1): Acceptable if flange height is greater than 1.90 mm.
*(2): (no cracking), Δ (shrinked).

[EXAMPLE 4]

Zn-containing aluminum alloys of Table 7, with a value of about 1.9 in the amount of Fe wt%+(Mn wt%×1.07)+(Mg wt%×0.27), were smelted and cast into 500 mm thick ingots, followed by a soaking treatment of 570° C.×6 hrs., hot rolling into a thickness of 3 mm and then cold rolling into a thickness of 1 mm. Immediately after the resulting sheets to 580° C. at a heating speed of 500° C./min, they were colled at a cooling speed of 50° C./min and again cold rolled to obtain 0.4 mm thick sheets for can body and 0.3 mm thick sheets for can end. There were also prepared a comparative material No. 8 which contained Zn only at the level of impurities and a comparative material No. 11 which was manufactured by a conventional method.

Table 8 shows the mechanical properties and average crystal grain width of the specimens thus obtained. It will be seen therefrom that the specimens Nos. 8, 9 and 10 according to the present invention have a higher in strength after baking and a smaller average grain width below 25 microns as compared with the comparative specimen No. 11. Further, shown in Table 9 are results of assessment on typical properties of can body and end materials, from which it will be seen that specimens according to the present invention (Nos. 9 and 10) are superior in ironing workability after rolling as well as in flangeability and rivet formability after baking, exhibiting the effect of the Zn content.

TABLE 7

| No. | Chemical Composition (wt %) Si | Fe | Cu | Mn | Mg | Zn | Ti |
|---|---|---|---|---|---|---|---|
| 8 | 0.15 | 0.40 | 0.23 | 1.07 | 1.22 | 0.03 | 0.02 |
| 9 | 0.15 | 0.41 | 0.23 | 1.08 | 1.17 | 0.23 | 0.02 |
| 10 | 0.16 | 0.42 | 0.23 | 1.06 | 1.19 | 0.39 | 0.02 |

No. §: a comparative specimen with a Zn content of 0.03 wt % (a level of impurities).
Si, Ti: Impurities

TABLE 8

| No. | After Rolling T.S. (kg/mm²) | After Rolling Y.S. (kg/mm²) | After Rolling El (%) | After Baking (200° C. × 20 min) T.S. (kg/mm²) | After Baking (200° C. × 20 min) Y.S. (Kg/mm²) | After Baking (200° C. × 20 min) El (%) | C. Grain width (μm) |
|---|---|---|---|---|---|---|---|
| 8 | 29.8 | 28.2 | 3.3 | 31.7 | 27.9 | 6.0 | 16.3 |
| 9 | 30.0 | 28.4 | 3.9 | 32.0 | 28.0 | 6.4 | 15.8 |
| 10 | 30.3 | 28.8 | 3.7 | 31.8 | 27.8 | 6.3 | 16.2 |
| 11 | 29.4 | 27.6 | 3.3 | 29.1 | 25.4 | 5.6 | 34.4 |

No. 8: A comparative specimen with a Zn content of 0.03 wt %, a level of impurities.
No. 11: A comparative specimen obtained by processing the alloy No. 8 by a conventional method without continuous annealing.

TABLE 9

| No. | Y.S. after rolling (kg/mm²) | Ironing (yield of products w/54% ironing rate) | Y.S. after being (kg/mm²) | Flangeability (yield of products w/12% flange rate | Fivet formability (multi-step extension height)* |
|---|---|---|---|---|---|
| 8 | 28.2 | 54.5% | 27.9 | 51.9% | 1.89 mmh |
| 9 | 28.4 | 60.9% | 28.0 | 65.0% | 1.92 |
| 10 | 28.8 | 72.7% | 27.8 | 82.2% | 1.94 |
| 11 | 27.6 | 50.0% | 25.4 | 59.3% | 1.86 |

*Acceptable if greater than 1.90 mm.

[EXAMPLE 5]

Following are the effect of Zn addition and the influence of the amount of Fe wt%+(Mn wt%×1.07)+(Mg wt%×0.27) in a case where a small-size continuous casting machine is used. There were used specimens of the chemical compositions shown in Table 10, of which the specimen No. 15 alone was in the range of the invention and other specimens were outside the range of the invention with regard to either the additive amount of Zn or the amount of Fe wt%+(Mn wt%×1.07)+(Mg wt%×0.27). The specimens were prepared by casting 40 mm thick ingots, followed by heating, hot rolling and intermediate annealing under the same conditions as in Example 3 except that the rate of cold rolling down to the ultimate sheet thickness (0.40 mm for can body material and 0.3 mm for can end material) was varied according to the composition (Mn and Mg contents) so that they would reach the same level of strength after baking. Shown in Table 11 are the mechanical properties and crystal grains at the thickness of 0.4 mm (which also apply to 0.3 mm thick specimens). All the specimens exhibited bake hardening (i.e., T.S. after baking is higher than T.S. after rolling in each case), with an average crystal grain width smaller than 25 microns. The properties in formability were as shown in Table 12, the specimen No. 15 according to the present invention showing the highest ironing workability after rolling due to the effect of Zn addition and satisfaction of the condition of Fe wt%+(Mn wt%×1.07)+(Mg wt%×0.27)=2.0–3.0. Although the flageability and rivet formability after baking are improved by a reduction in the distribution (amount and length) of intermetallic compounds and addition of Zn, and the specimen No. 15 has the most favorable properties in consideration of its ironing workability.

Thus, it will be seen that, in a manufacturing process using a small-size continuous casting machine, the amount of Fe wt%+(Mn wt%×1.07)+(Mg wt%×0.27) should be in the range of 2.0–3.0, and properties in formability can be further improved by addition of Zn.

TABLE 10

| No. | Chemical Composition (wt %) Si | Fe | Cu | Mn | Mg | Zn | Ti | Fe wt % + (Mn wt % × 1.07 + (Mg wt % × 0.27) |
|---|---|---|---|---|---|---|---|---|
| 12 | 0.15 | 0.42 | 0.23 | 1.07 | 1.23 | 0.03* | 0.02 | 1.89 |
| 13 | 0.16 | 0.44 | 0.22 | 1.06 | 1.20 | 0.40 | 0.02 | 1.90 |
| 14 | 0.20 | 0.57 | 0.21 | 1.12 | 1.54 | 0.03* | 0.01 | 2.18 |
| 15 | 0.21 | 0.60 | 0.22 | 1.10 | 1.56 | 0.43 | 0.02 | 2.20 |
| 16 | 0.20 | 0.75 | 0.21 | 1.88 | 2.05 | 0.45 | 0.02 | 3.31 |

*At a level of impurities.
Si, Ti: Impurities

TABLE 11

| No. | After Rolling T.S. (kg/mm²) | After Rolling Y.S. (kg/mm²) | After Rolling El (%) | After Baking (200° C. × 20 min) T.S. (kg/mm²) | After Baking (200° C. × 20 min) Y.S. (kg/mm²) | After Baking (200° C. × 20 min) El (%) | C. Grain width (μm) |
|---|---|---|---|---|---|---|---|
| 12 | 30.0 | 28.3 | 3.4 | 32.0 | 28.1 | 6.3 | 16.5 |
| 13 | 30.0 | 28.4 | 3.4 | 32.1 | 28.2 | 6.2 | 16.7 |
| 14 | 30.3 | 28.6 | 3.0 | 32.5 | 28.3 | 6.0 | 17.0 |
| 15 | 30.1 | 28.4 | 3.1 | 32.3 | 28.1 | 6.1 | 16.4 |
| 16 | 30.4 | 28.6 | 3.2 | 32.1 | 28.2 | 6.3 | 17.2 |

TABLE 12

| No. | Y.S. after rolling ($kg/mm^2$) | Ironing (yield) of production w/54% ironing rate | Y.S. after being ($kg/mm^2$) | Stretch-flange-ability (yield of products w/ 12% flange rate) | Rivet formability (multi-step stretching height)* |
|---|---|---|---|---|---|
| 12 | 28.3 | 35.4% | 28.1 | 100% | 2.02 |
| 13 | 28.4 | 53.0% | 28.2 | 100% | 2.05 |
| 14 | 28.6 | 78.2% | 28.3 | 95% | 1.95 |
| 15 | 28.4 | 100% | 28.1 | 100% | 2.00 |
| 16 | 28.6 | 58.3% | 28.2 | 58% | 1.85 |

*Acceptable if greater than 1.90 mm.

It will be seen from the graphs in the accompanying drawings that the value of the formula Fe wt%+(Mn wt%×1.07)+(Mg wt%×0.27) should be smaller than 3, preferably smaller than 2.7 in the case of a large-size ingot while it should be in the range of 2.0–3.0 in the case of a small-size ingot. Otherwise it becomes difficult to obtain intermetallic compounds (crystallized products) of the required size (smaller than 45 microns) and amount (0.5–5.0%), resulting in degradations in ironing workability, flangeability and rivet formability. By adding Zn in a range which satisfies the condition of the formula, it becomes possible to maintain or improve the ironing workability, flangeability and rivet formability which are normally considered to be degraded by an increase in strength of an aluminum alloy.

As clear from the foregoing description and examples, the formable aluminum alloy sheet and its manufacturing method according to the present invention can be suitably applied not only to can bodies but also to can ends and tabs owing to improvements in forming workability, particularly in ironing workability, flangeability and rivet formability.

What is claimed is:

1. A method for producing a formable bake-hardening type aluminum alloy sheet, comprising:

smelting an aluminum alloy consisting essentially of 0.2–0.7 wt% of Fe, 0.05–0.5 wt% of Cu, 0.5–2.5 wt% of Mg and 0.5–2.0 wt% of Mn in the range of Fe wt%+(Mn wt%×1.07)+(Mg wt%×0.27)≦3.0 as alloying ingredients with the remainder being aluminum and impurities;

casting said aluminum alloy in a thickness greater than 100 mm;

soaking the resulting ingot at a temperature higher than 530° C.;

hot rolling the soaked ingot optionally followed by cold rolling;

heating the rolled work to a temperature of 430°–600° C. at a heating speed higher than 100° C./min;

immediately thereafter or after retaining said work for a time period shorter than 10 minutes, cooling same to a temperature below 150° C. at a cooling speed higher than 100° C./hour thereby producing average crystal grains smaller than 25 microns while holding in solid solution the components contributive to bake hardening; and cold rolling said work at a reduction rate greater than 10% with a total reduction rate of hot and cold rolling greater than 99%.

2. The method as set forth in claim 1, wherein said aluminum alloy further contains 0.05–1 wt% of Zn.

3. The method as set forth in claim 2, wherein the amount of Fe wt%+(Mn wt%×1.07)+(Mg wt%×0.27) is in a range of ≦2.7.

4. A method for producing a formable bake-hardening type aluminum alloy sheet, comprising;

smelting aluminum alloy consisting essentially of 0.2–0.7 wt% of Fe, 0.05–0.5 wt% of Cu, 0.5–2.5 wt% of Mg and 0.5–2.0 wt% of Mn in the range of Fe wt%+(Mn wt%×1.07)+(Mg wt%×0.27)=2.0–3.0 as alloying ingredients with the remainder being aluminum and impurities;

casting said aluminum alloy in a thickness smaller than 50 mm by quenching continuous casting optionally followed by hot rolling;

optionally cold rolling the resulting work after or without a heat treatment at a temperature higher than 300° C.;

heating said work to a temperature of 430°–600° C. at a heating speed higher than 100° C./min;

immediately thereafter or after retaining said work for a time period shorter than 10 minutes, cooling same to a temperature below 150° C. at a cooling speed higher than 100° C./hr to produce average crystal grains smaller than 25 microns while holding in solid solution the components contributive to bake hardening; and cold rolling said work at a reduction rate greater than 10% with a total reduction rate of hot and cold rolling greater than 90%.

5. The method as set forth in claim 4, wherein said aluminum alloy further contains 0.5–1 wt% of Zn.

6. A formable bake hardening type aluminum alloy sheet, consisting essentially of 0.2–0.7 wt% Fe, 0.05–0.5 wt% Cu, 0.5–2.5 wt% Mg and 0.5–2.0 wt% Mn in the range of Fe wt%+(Mn wt%×1.07)+(Mg wt%×0.27)≦3.0 as alloying ingredients with the remainder being aluminum and impurities, said alloy sheet containing intermetallic compounds of less than 45 microns in size and the areal rate of the intermetallic compounds as observed from the surface of a rolled sheet ranges from 0.5–5% and an average crystal grain width less than 25 microns.

7. The alloy sheet of claim 6, wherein the alloy contains at least one impurity selected from the group consisting of less than 0.5% Si, less than 0.10% Ti, less than 0.05% B and less than 0.05% Cr.

8. The bake-hardening type aluminum alloy sheet as set forth in claim 6, wherein said aluminum alloy further contains 0.05–1 wt% of Zn.

* * * * *

UNITED STATES PATENT AND TRADEMARK OFFICE

CERTIFICATE OF CORRECTION

PATENT NO. : 4,753,685

DATED : June 28, 1988

INVENTOR(S) : Usui et al

It is certified that error appears in the above-identified patent and that said Letters Patent is hereby corrected as shown below:

Column 1, line 39, delete "rivete" and insert --rivet--,

Column 2, lines 2 & 3, delete "alluminum" and insert --aluminum--, line 14, delete "alluminum" and insert --aluminum--, line 16, insert --wt-- after "0.05-0.5", line 35, delete "alluminum" and insert --aluminum--, line 37, insert --wt-- after "0.05-0.5--, line 55, delete "alluminum" and insert --aluminum--, Column 3, line 32, delete "Fe.Mn)" and insert --(Fe·Mn)--, Column 4, line 7, insert --an-- after "important", line 17, delete "riving" and insert --giving--, Column 5, line 8, delete ", should" and insert --. Should--, line 31, delete "alluminum" and insert --aluminum--, line 42, insert --the-- after "because", line 44, change "favorably" to --favorable--, Column 8, line 21, delete "are" and insert --is--,

UNITED STATES PATENT AND TRADEMARK OFFICE

CERTIFICATE OF CORRECTION

PATENT NO. : 4,753,685

DATED : June 28, 1988

INVENTOR(S) : Usui et al

It is certified that error appears in the above-identified patent and that said Letters Patent is hereby corrected as shown below:

Column 9, line 9, delete "a" (first occurrence) and insert --an--, line 26, delete "rivete" and insert --rivet--, line 52, delete "condition" and insert --conditions--, Column 10, line 7, delete "mg" and insert --Mg--, 53, delete "has" and insert --have--, 68, delete "were" and insert --was--, Column 11, line, 57, after "sheets" insert --were heated--, 58, delete "colled" and insert --cooled--, 68, delete "in" and insert --tensile--, Column 14, line 35, delete "flageability" and insert --flangeability--, 38, delete "and", Column 16, line 18, delete ";" and insert --:--, 45, delete "0.5-1" and insert --0.05-1--,

UNITED STATES PATENT AND TRADEMARK OFFICE

CERTIFICATE OF CORRECTION

PATENT NO. : 4,753,685

DATED : June 28, 1988

INVENTOR(S) : Usui et al

It is certified that error appears in the above-identified patent and that said Letters Patent is hereby corrected as shown below:

Columns 1, line 12 & Column 2, lines 29-30 & 52, Column 14, line 25, Column 15, line 60, Column 16, lines 40 & 46, delete "bake hardening" and insert --bake-hardening--, Table 1, the subheading under "Distrib'n of Intermet'c Comp." insert --)-- after "0.27", Table 3, under the heading "Distrib'n of Inter'c C." the subheadings should read as:

| Max length (μm) | Areal rate (%) |
|---|---|

Table 3, under the heading "*2" The vertical list of symbols should read as:

○

○

○

○

Ⓐ

Ⓐ

Δ

○

UNITED STATES PATENT AND TRADEMARK OFFICE

CERTIFICATE OF CORRECTION

PATENT NO. : 4,753,685

DATED : June 28, 1988

INVENTOR(S) : Usui et al

It is certified that error appears in the above-identified patent and that said Letters Patent is hereby corrected as shown below:

Table 6, under the heading "Tab Property" The vertical list of symbols should read as:

o o o o o o

Ⓐ o

UNITED STATES PATENT AND TRADEMARK OFFICE

CERTIFICATE OF CORRECTION

PATENT NO. : 4,753,685

DATED : June 28, 1988

INVENTOR(S) : Usui et al

It is certified that error appears in the above-identified patent and that said Letters Patent is hereby corrected as shown below:

Table 6, footnote "(2)", should read in part as --0/(no cracking)--,

Table 9, the last heading should read as --Rivet form--,

Table 10, an ending parenthesis should be included after "1.07".

Signed and Sealed this

Eleventh Day of July, 1989

*Attest:*

DONALD J. QUIGG

*Attesting Officer*

*Commissioner of Patents and Trademarks*